US005270782A

United States Patent [19]

Floyd, Jr.

[11] Patent Number: 5,270,782

[45] Date of Patent: Dec. 14, 1993

[54] SINGLE-COMPONENT DEVELOPMENT SYSTEM WITH INTERMEDIATE DONOR MEMBER

[75] Inventor: Lawrence Floyd, Jr., Rochester, N.Y.

[73] Assignee: Xerox Corporation, Stamford, Conn.

[21] Appl. No.: 812,081

[22] Filed: Dec. 23, 1991

[51] Int. Cl.[5] ..... G03G 15/06

[52] U.S. Cl. ..... 355/245; 118/661; 355/246; 355/259

[58] Field of Search ..... 355/251, 253, 246, 245, 355/249, 260, 247, 261; 118/656, 657, 658, 661, 651, 653

[56] References Cited

U.S. PATENT DOCUMENTS

| | | | |
|---|---|---|---|
| 3,872,826 | 3/1975 | Hanson | 118/8 |
| 3,906,899 | 9/1975 | Harpauat | 118/637 |
| 3,929,098 | 12/1975 | Liebman | 118/637 |
| 4,498,756 | 2/1985 | Hosoya et al. | 355/259 |
| 4,571,060 | 2/1986 | Bares . | |
| 4,697,914 | 10/1987 | Hauser . | |
| 4,809,034 | 2/1989 | Murasaki et al. . | |
| 4,833,504 | 5/1989 | Parker et al. | 355/326 |
| 4,868,600 | 9/1989 | Hays et al. | 355/259 |
| 4,868,611 | 9/1989 | Germain | 355/328 |
| 4,876,575 | 10/1989 | Hays | 355/259 |
| 4,990,958 | 2/1991 | Brewington et al. | 355/245 |
| 5,010,368 | 4/1991 | O'Brien | 355/259 |
| 5,012,287 | 4/1991 | Knapp | 355/253 |
| 5,047,806 | 9/1991 | Brewington et al. | 355/259 |
| 5,063,875 | 11/1991 | Folkins et al. | 118/651 |
| 5,077,578 | 12/1991 | Grammatica et al. | 355/259 |

*Primary Examiner*—A. T. Grimley
*Assistant Examiner*—Thu Dang
*Attorney, Agent, or Firm*—Denis A. Robitaille

[57] ABSTRACT

An apparatus for developing an electrostatic latent image on an image support surface. A rotating advancing member advances single component developer material from a toner supply sump in a chamber to an intermediate donor roll. The intermediate donor roll transports a metered amount of developer material to a down roll adjacent to the latent image where the developer material is attracted to the latent image for development thereof. The intermediate donor roll is provided in configuration with the donor roll for preventing escape of developer material from the chamber to increase the life of mechanical components and to decrease background.

16 Claims, 3 Drawing Sheets

SINGLE-COMPONENT DEVELOPMENT SYSTEM WITH INTERMEDIATE DONOR MEMBER

This invention relates generally to an electrophotographic printing machine, and more particularly concerns a single component development system designed to substantially minimize the amount of marking particle escape therefrom.

Generally, the process of electrostatographic copying is executed by exposing a light imagke of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. Charged developing mateial is subsequently deposited onto the photoreceptive member such that the developing material is attracted to the charged image areas on the photoconductive surface thereof to develop the electrostatic latent image into a visible image. The developing material is then transferred from the photoreceptive member, either directly or after an intermediate transfer step to an intermediate surface, to a copy sheet or other support substrate to create an image which may be permanently affixed to the copy sheet, providing a reproduction of the original document. In a final step, the photoconductive surface of the photoreceptive member is cleaned to remove any residual developing material thereon in preparation for successive imaging cycles.

The described electrostatographic copying process is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The process of developing a latent image on a photoreceptive member is carried out at a developer station. In such systems toner particles are deposited on an electrostatic latent image contained on a photoconductive surface, such as selenium, using, for example, the development methods described in U.S. Pat. No. 3,618,552, cascade development; U.S. Pat. Nos. 2,874,063; 3,251,706; and 3,357,402, magnetic brush development, and U.S. Pat. No. 2,217,776, powder cloud development, and U.S. Pat. No. 3,166,432, touchdown development. The cascade development method and powder cloud development method are especially well adopted for the development of line images common to business documents. Images which contain solid areas are, however, sometimes not faithfully reproduced by these methods. Accordingly, magnetic brush development systems are employed to produce both lines and solid areas.

Toner particles, or marking particles, terms which are used interchangably throughout this application, are attracted to the latent image forming a toner powder image on the photoconductive surface so as to develop the latent image. Two component and single component developer materials are commonly used for image development. A typical two component developer material comprises magnetic carrier granules having toner particles adhering trioelectrically thereto while a single component developer material is typically comprised of only toner particles.

Two component development systems have been used extensively in many different types of printing machines. Magnetic brush development systems employing two-component developer mixtures comprised of toner particles and carrier particles are extensively used in electrophotographic devices, since such systems generally provide for the production of high quality images, including dense solid areas, and also reduce unwanted toner deposition in background areas.

Nevertheless, problems continue to exist in the design of simple, inexpensive and efficient two-component systems with respect to long-term stability, which problems are in part caused by the need to generate a triboelectric charge on the toner particles with a desired polarity of sufficient magnitude. Further, vigorous developer mixing is required, which is accomplished in a reservoir or sump using a mixing means such as a paddle-wheel, is required to provide the continual multiple contacts between toner particles and carrier particles to charge uncharged toner particles in the developer mixture. This continual mixing of the developer composition causes toner smearing on the carrier particles, causing an irreversible degradation in the ability of the carrier particles to triboelectrically charge the toner particles. Such degradation usually results in inferior copy quality, including undesirable increased background development.

Additionally, the xerographic development properties of two-component developer compositions is dependent on the concentration of toner particles in the developer mixture. Therefore, in order to maintain stable xerographic development properties during cyclic machine operation, the toner concentration is monitored by a device which controls the rate at which toner particles are dispersed to the developer reservoir. The components and hardware required for such toner concentration control devices add significantly to the complexity and cost to two-component systems.

In view of some of the disadvantages of two component systems, there have been considerable efforts directed to designing systems which utilize single-component developer comprising toner particles only, reference for example, U.S. Pat. No. 2,846,333. Single component development systems use a donor roll for transporting charged toner to the development nip defined by the juxtaposed portions of the donor roll and the photoconductive member. The toner is developed onto the latent image recorded on the photoconductive member by a combination of mechanical and/or electrical forces. Generally, these systems eliminate the need for a developer reservoir as well as toner concentration control means.

Most of the single component development systems found in commercial use, consume conductive toner particles, whereby imagewise toner deposition onto the photoconductor is attained by inductive toner charging. Scavengeless development and jumping development are two types of such single component development. In a scavengeless development system, a donor roll is provided with a plurality of electrode wires closely spaced therefrom in a development nip. An AC voltage is applied to the electrode wires, forming a toner cloud in the development region. Thereafter, the electrostatic fields generated by the latent image attract toner from the toner cloud to develop the latent image. Alternatively, in jumping development, an AC voltage is applied to the donor roll such that the toner particles are detached from the donor roll and projected toward the photoconductive member so that the electrostatic fields generated by the latent image attract the toner particles to develop the latent image. Single component development systems appear to offer advantages in cost and design simplicity. However, the achievement of high reliability and easy manufacturability of such single component development systems may present a problem with respect to commercial applicability.

Clearly, two component development systems and single component development systems each have their own advantages and disadvantages. One of the problems associated with either type of development system arises from the necessarily vigorous mixing and agitation imparted on developer materials. Such agitation creates problems associated with contamination of the various processing stations of the reproducing apparatus due to toner particles escaping from the housing in which they are contained. Toner particles often escape from the developer housing as they become airborne and/or electrically excited.

The problems of toner or marking particle escape, and machine contamination thereby, are long standing ones in the electrostatography art. Toner particles are very fine and very difficult to confine. Further, the material is electrostatically attractable and carries electrical charges. These particles may be attracted to critical surfaces of the various processing stations resulting in contamination and degradation of the performance of the subsystem. For example, if toner is allowed to collect on a lens or a mirror, total exposure of the input document is dramatically decreased and a problem with background may result. Likewise, the same difficulties may result if toner is allowed to collect on the viewing platen or the illuminating lamps of the reprographic system. In addition, it should be noted that escaping toner particles may also interfere with mechanical mechanisms or seriously damage various machine components.

Generally, a development system will be provided with a geometrical seal located between the developer housing and the photoconductive insulating member to prevent leakage of toner particles therefrom. Alternatively, in addition thereto, a developer housing may be maintained at negative pressure to ensure that air flow is directed toward the toner storage chamber. However, such negative pressure devices are expensive and require additional space for ducting within the automatic reproducing machine. Moreover, it is generally observed that even with the foregoing precautions, toner particles tend to escape from within the developer housing. The peculiar characteristics of toner particles and the requirements for protecting the photoreceptor surface preclude the use of specific configurations or existing materials which might otherwise be suitable for different materials or different environments.

While improvements have been made in the apparatus, process and materials for developing latent electrostatic images, there continues to be a need for processes which improve the quality of development, which are efficient, which are simple in design, and which are economical. In particular, there is a need for a single-component development system wherein insulative, non-magnetic, and colored toner particles can be appropriately charged so as to enable the efficient electrostatic transfer of such particles to plain paper while the particle can be retained within the developer housing such that background is substantially controlled and/or eliminated and the reliability of the system hardware, and materials is increased.

Accordingly, it is desirable to provide a single component development system wherein there is minimal or negligible emission of marking particles outside of the housing. Various types of development systems have been devised. The following disclosures appear to be relevant:

U.S. Pat. No. 3,872,826
Patentee: Hanson
Issued: May 25, 1975

U.S. Pat. No. 3,906,899
Patentee: Harpavat
Issued: Sep. 23, 1975

U.S. Pat. No. 3,929,098
Patentee: Liebman
Issued: Dec. 30, 1975

U.S. Pat. No. 4,571,060
Patentee: Bares
Issued: Feb. 18, 1986

U.S. Pat. No. 4,697,914
Patentee: Hauser
Issued: Oct. 6, 1987

U.S. Pat. No. 4,809,034
Patentee: Murasaki et al.
Issued: Feb. 28, 1989

U.S. Pat. No. 4,833,504
Patentee: Parker et al.
Issued: May 23, 1989

U.S. Pat. No. 4,868,600
Patentee: Hays et al.
Issued: Sep. 19, 1989

U.S. Pat. No. 4,868,611
Patentee: Germaine
Issued: Sep. 19, 1989

U.S. Pat. No. 4,876,575
Patentee: Hays
Issued: Oct. 24, 1989

U.S. Pat. No. 4,990,958
Patentee: Brewington et al.
Issued: Feb. 5, 1991

U.S. Pat. No. 5,047,806
Patentee: Brewington et al.
Issued: Sep. 10, 1991

Co-pending U.S. patent application Ser. No. 07/396,153
Applicant: Folkins
Filed: Aug. 21, 1989

Co-pending U.S. patent application Ser. No. 07/428,726
Applicant: Brewington et al.
Filed: Oct. 30, 1989

Co-pending U.S. patent application Ser. No. 07/422,427
Applicant: Barker et al.
Filed: Jun. 27, 1991

The relevant portions of the foregoing disclosures may be briefly summarized as follows:

U.S. Pat. No. 3,872,826 discloses a developer housing including a top seal and end seals. The end seals are located on either side of the developer housing in the development zone. Each end seal is a strip of polymethyl foam secured to the developer housing with the free end in contact with the photoconductive drum. The top seal is a brush secured to the top of the developer housing with the free end of the brush contacting the photoconductive drum.

U.S. Pat. No. 3,906,899 describes a magnetic seal for a developer housing. The magnet attracts magnetic particles to form a seal between the developer housing and the photoconductive drum.

U.S. Pat. No. 3,929,098 describes a developer sump located below a donor roll. A developer mix of toner particles and ferromagnetic carrier granules is in the sump. A cylinder having a magnet disposed therein rotates through the developer mix and conveys the developer mix adjacent the donor roll. An electrical field between the cylinder and donor roll loads the donor roll with toner particles.

U.S. Pat. No. 4,571,060 discloses an apparatus for sealing a housing to prevent the escape of toner particles therefrom. The toner particles are captured and softened to become tacky. Additional toner particles stick to the tacky toner particles preventing their escape. Each successive layer of captured toner particles soften and become tacky, capturing other toner particles thereto.

U.S. Pat. No. 4,697,914 discloses an apparatus and method for reducing toner contamination including an electrostatic seal arrangement having at least one electrode extending across the width of an exit portion of a developer housing to create an electric field barrier in the exit portion sufficient to repel the charged particles back into the principle portion of the housing.

U.S. Pat. No. 4,809,034 discloses a developing device having a non-magnetic developing sleeve. A magnetic roller is incorporated in the developing sleeve. A toner supply roller transports toner to the developing sleeve from the toner reservoir. The electrical potential on the supply roller is lower than that on the surface of the developing sleeve so that toner is attracted to the developing sleeve forming a brush of toner thereon. The developing sleeve conveys the brush of toner into contact with the photoconductive drum to develop the latent image recorded thereon.

U.S. Pat. Nos. 4,833,504 and 4,868,611 disclose a single pass highlighted color printer having a scavengeless developer unit containing a plurality of developer rolls. The developer rolls include rotating, non-magnetic cylinders or shells with roughened surfaces and stationary magnets.

U.S. Pat. No. 4,868,600 described a scavengeless development system in which a donor roll has toner deposited thereon. A pair of electrode wires are closely spaced to the donor roll in the gap between the donor roll and the photoconductive member. An AC voltage is applied to the electrode wires to detach toner from the donor roll and form a toner powder cloud in the gap. Toner from the toner powder cloud is attracted to the latent image recorded on the photoconductive member to develop the latent image recorded thereon. A conventional magnetic brush used with two component developer could be used for depositing the toner layer onto the donor roll.

U.S. Pat. No. 4,876,575 discloses a donor roll having a rotating metering and charging rod forming a toner metering and charging zone through which toner is moved to simultaneously charge and meter the toner particles. The rod is supported by a distributed bearing attached to a compliant blade. A toner cleaning blade held against the rod serves as a toner seal. The rod is electrically biased.

U.S. Pat. No. 4,990,958 describes a scavengeless development apparatus in which toner detachment from a donor roll and generation of a controlled powder cloud is obtained by AC electrically biased electrode wires. A reload member supported in rubbing contact with an electrically biased toner mover effects reloading of the donor roll with toner. The toner mover serves to transport toner from a remote supply of toner to an area opposite the donor roll.

U.S. Pat. No. 5,047,806 and co-pending U.S. patent application Ser. No. 07/428,726 describe a development system having a hollow tube having holes therein which fluidizes and moves toner particles from one end of a developer housing to the other end thereof. The tube is electrically biased so that toner particles are attracted from the tube to a donor roller. A charging blade is maintained in contact with the donor roll to charge the toner layer on the donor roller.

Co-pending U.S. patent application Ser. No. 07/396,153 discloses a hybrid development system wherein a magnetic roll advances a developer material having carrier and toner particles to a donor roll for depositing a substantially constant amount of toner having a substantially constant triboelectric charge on the donor roll. A plurality of electrode wires are positioned adajcent the donor roll and proximate an image support surface to form a toner cloud to develope a latent image on theimage support surface.

Co-pending U.S. patent application Ser. No. 07/722,427 describes an apparatus for developing latent images on a photoconductive member having a donor member for transporting toner aprticles to a development zone adjacent the photoconductive member. Electrically biased electrode wires are positioned in the development zone so as to detach toner particles from the donor roll, forming a toner cloud to develope the latent image. The electrode wires are adjustably supported in tension adjacent the donor member.

In accordance with one aspect of the present invention, there is provided an apparatus for developing a latent image recorded on an photoconductive image support surface with toner or marking particles. The apparatus includes a development housing defining a chamber for storing a supply of single component developer material comprising toner or marking particles. Means are provided for advancing the marking particles into and within the chamber of the housing. A non-magnetic intermediate donor member is mounted within the chamber located proximate to the advancing means for collecting marking particles therefrom. A donor member is also mounted within the chamber and spaced adjacent to the image support surface and proximate to the intermediate donor member, adapted to transport marking particles from the intermediate donor roll to a region on the image support surface. The advancing means and the intermediate donor member cooperate with one another to deposit a substantially constant amount of marking particles having a substantially constant triboelectric charge onto the donor member. The marking particles are attracted from the donor member to the image support member via electrostatic and/or mechanical means. The advancing means and the intermediate donor member are positioned progressively more distant from the image support surface than the donor member so as to substantially minimize escape of marking particles from the housing. In an alternative embodiment of the invention, a plurality of electrode members are positioned in a development region between the image support surface and the donor member so as to form a cloud of marking particles therein to develop the latent image.

Pursuant to another aspect of the present invention, there is provided an electrophotographic printing machine of the type in which an electrostatic latent image recorded on a photoconductive member is developed to form a visible image thereof. The improvement includes a development housing defining a chamber for storing a supply of single component developer material comprising toner or marking particles. Means are provided for advancing the marking particles in the chamber of the housing. An intermediate donor member is located proximate to the advancing means for collecting marking particles therefrom. A donor member is spaced adjacent the image surface and proximate to the intermediate donor member, adapted to transport marking particles from the intermediate donor roll to a region on the image support surface. The advancing means and the intermediate donor member cooperate with one another to deposit a substantially constant amount of marking particles having a substantially constant triboelectric charge onto the donor member. The marking particles are then attracted from the donor member to the image support member via electrostatic and/or mechanical means. The advancing means and the intermediate donor member are positioned progressively more distant from the image support surface than the donor member so as to substantially minimize escape of marking particles from the housing. In an alternative embodiment of the invention, an electrode member is positioned in the space between the image support surface and the donor member. The electrode member is electrically biased to detach marking particles from the donor member so as to form a cloud of marking particles in the space between the electrode member to develop the latent image.

Other features of the present invention will become apparent as the following description proceeds and upon reference to the drawings, in which.

Figure 1:
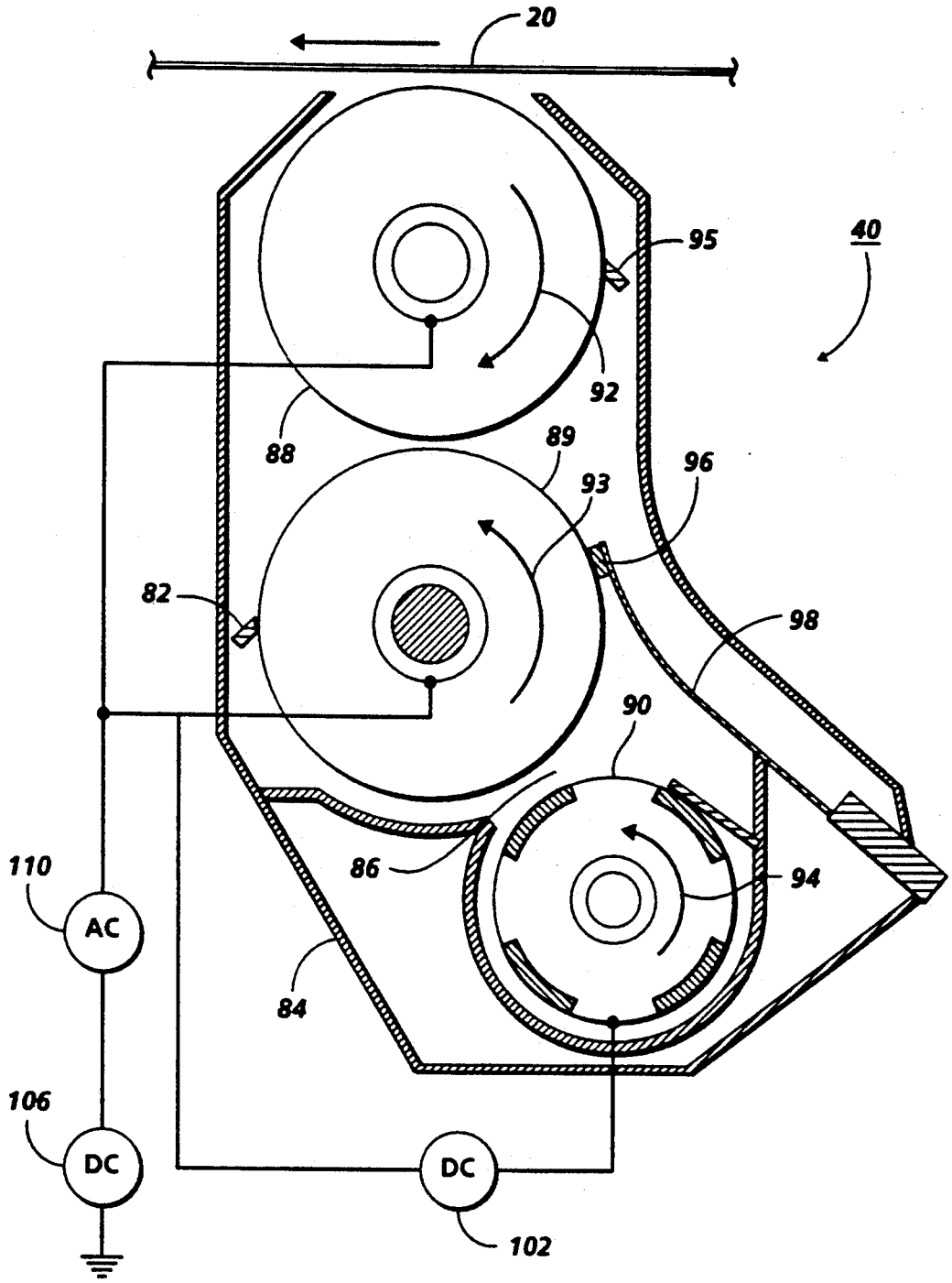
FIG. 1 is a schematic side view showing one embodiment of the development system of the present invention.

While the present invention will be described in connection with a preferred embodiment thereof, it will be understood that the detailed description is not intended to limit the invention to that embodiment. On the contrary, it is intended that the invention cover all alternatives, modifications, and equivalents as may be included within the spirit and scope thereof as defined by the appended claims. Other aspects and features of the present invention will become apparent as the description proceeds wherein like reference numerals have been used throughout to designate identical elements.

Figure 3:
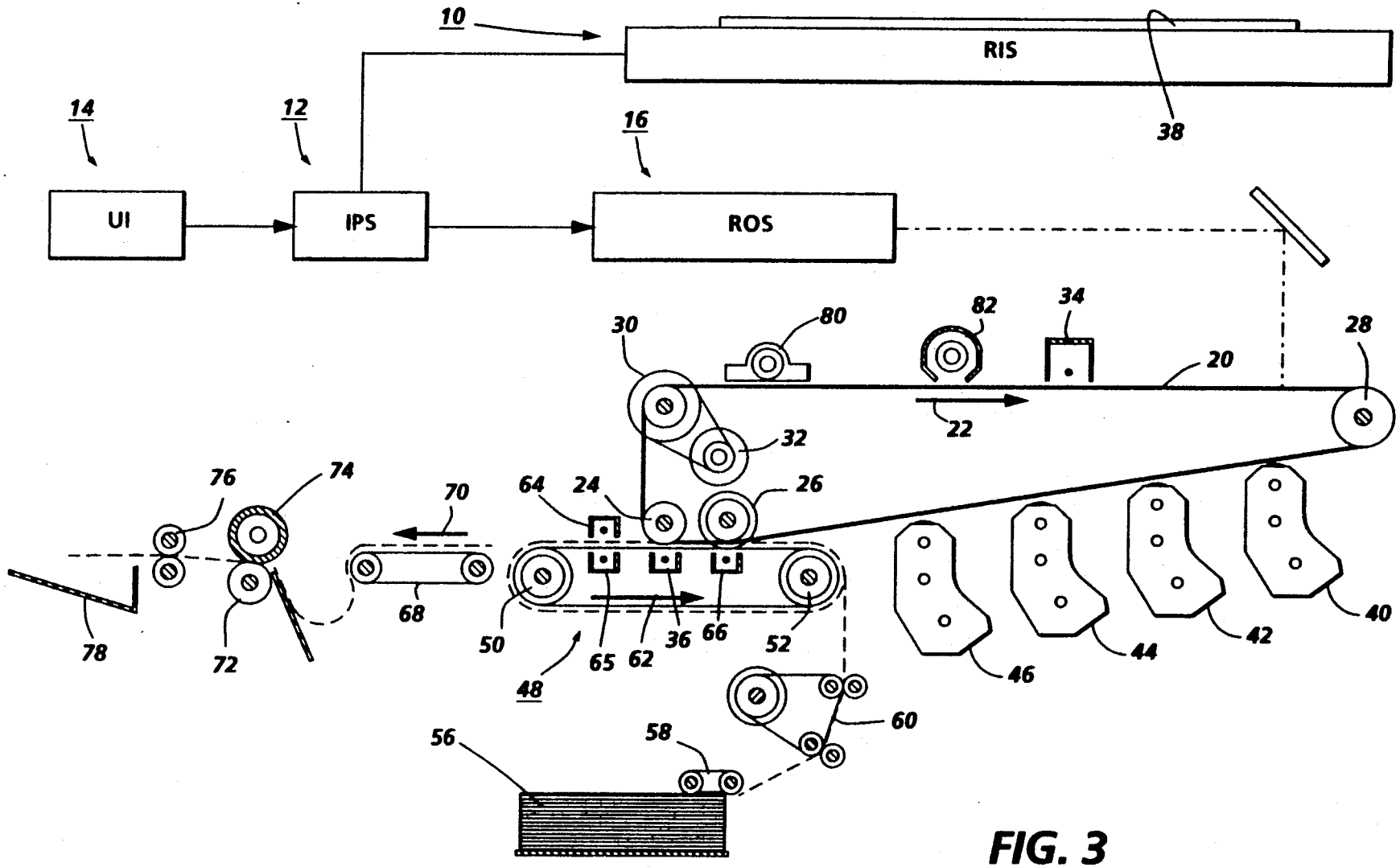
FIG. 3 is a schematic side view of an exemplary electrophotographic printing machine incorporating a development system having the features of the present invention therein.

For a general understanding of an electrostatographic printing machine in which the features of the present invention may be incorporated, reference is initially made to FIG. 3, before describing the specific details of the invention. Inasmuch as the art of electrophotographic printing is well known, the various processing stations employed in the FIG. 3 printing machine will be shown hereinafter schematically and their operation will be described briefly with reference thereto. It will become apparent from the following discussion that the developer system of the present invention is equally well suited for use in a wide variety of electroreprographic machines, as well as a variety printing, duplicating and facsimile devices.

FIG. 3 shows an illustrative, multi-color electrophotographic printing machine, incorporating the development apparatus of the present invention therein, employing a raster input scanner (RIS), indicated generally by the reference numeral 10, for scanning a multi-color original document 38 positioned thereon. The RIS 10 contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document.

Information is transmitted from the RIS 10 to an image processing system (IPS), indicated generally by the reference numeral 12. IPS 12 comprises the control electronics which prepare and manage the image data flow to the raster output scanner (ROS), indicated generally by the reference numeral 16. A user interface (UI), indicated generally by the reference numeral 14, is in communication with the IPS 12 enabling an operator to control various operator adjustable functions.

The output signal from the UI 14 is transmitted to IPS 12. The signal corresponding to the desired image is transmitted from IPS 12 to ROS 16, which creates the output copy image. The ROS includes a laser having a rotating polygon mirror block associated therewith. ROS 16 lays out the image in a series of scan lines with each line having a specified number of pixels per unit measure. The ROS exposes the charged photoconductive surface of belt 20 in accordance with the scan lines to record a set of latent images on the photoreceptor. These latent images are developed with magenta, cyan, yellow, and black toner particles, respectively, wherein the developed images are transferred to a copy sheet in superimposed registration with one another to form a multi-colored image on the copy sheet which is then fused to the copy sheet forming a color copy. This process will be described in detail, hereinbelow.

Figure 2:
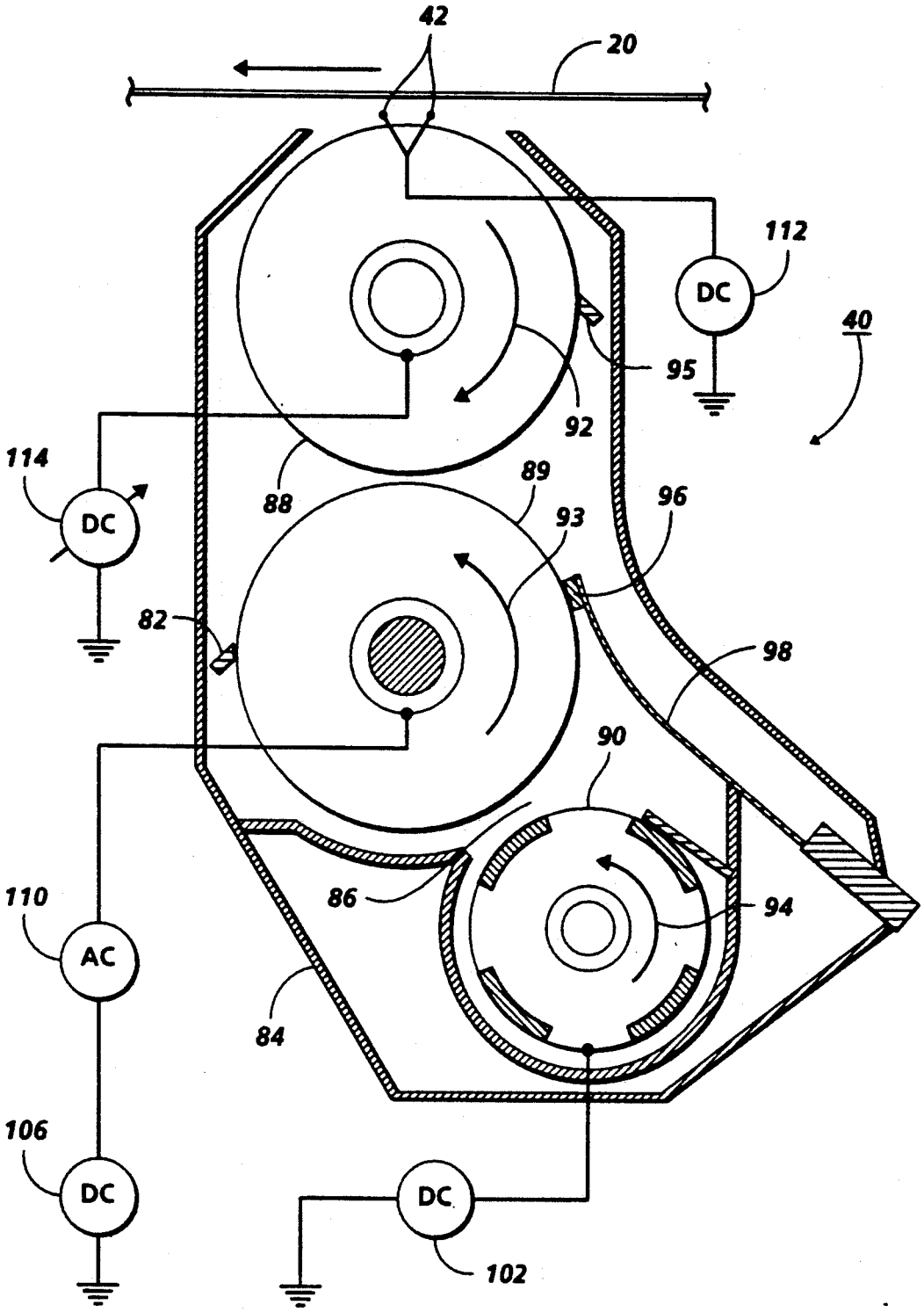
FIG. 2 is a schematic side view showing an alternative embodiment of the development system of the present invention.

With continued reference to FIG. 2, photoconductive belt 20 is made from a polychromatic photoconductive material and travels in the direction of arrow 22 to advance successive portions of the photoconductive surface sequentially through the various processing stations disposed about the path of movement thereof. Belt 20 is entrained about transfer roller 24, detack backup roller 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through the charging station. At the charging station, a corona generating device, indicated generally by the reference numeral 34 charges photoconductive belt 20 to a relatively high, substantially uniform potential.

Next, the charged photoconductive surface of belt 20 is transported to the exposure station. The exposure station includes the RIS 10 having a multi-color original document 38 positioned thereat. The RIS 10 captures the entire image from the original document 38 and converts it to a series of raster scan lines for transmission as electrical signals to IPS 12. The electrical signals from the RIS 10 correspond to the red, green and blue densities at each point in the document. The IPS 12 converts the set of red, green and blue density signals, i.e. the set of signals corresponding to the primary color densities of original document 38, to a set of colorimetric coordinates.

UI 14 may be a touch screen or any other suitable control panel for providing operator intercommunication with the system. The operator actuates the appropriate keys of the UI 14 to adjust the parameters of the output copy. The output signals from the UI 12 are transmitted to the IPS. The IPS then transmits signals corresponding to the desired image to ROS 16.

ROS 16 includes a laser with rotating polygon mirror blocks. Preferably, a nine facet polygon is used. Optimally, the ROS 16 illuminates the charged portion of photoconductive belt 20 at a rate of about 400 pixels per inch. The ROS 16 will expose the photoconductive belt 20 to record four latent images. One latent image is adapted to be developed with cyan toner. Another latent image is adapted to be developed with magenta toner. The third latent image is developed with yellow toner, and the fourth with black toner. The latent images formed by the ROS 16 on the photoconductive belt 20 correspond to the signals from IPS 12.

After the electrostatic latent image has been recorded onto photoconductive belt 20, belt 20 advances the electrostatic latent image to the development station including four individual developer units generally indicated by the reference numerals 40, 42, 44 and 46. The developer units are of a type generally referred to in the art as "single component development units." Typically, a single component development system employs a donor roll having charged toner particles adhering thereto. A charging blade or rod adjacent the donor roll charges the toner particles and regulates the quantity of toner particles adhering to the donor roll. Development is achieved by bringing the toner particles into contact with the photoconductive surface as will be discussed in greater detail herein.

Developer units 40, 42, and 44, respectively, apply toner particles of a specific color corresponding to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level which is ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from black information or text.

Only one of the developer units is operative during each development cycle. The remaining developer units are non-operative during a given development cycle to prevent co-mingling of different color toner particles. In order to switch the developer unit from the operative to the non-operative mode, toner particles are removed form the donor roll of the non-operative developer unit. By contrast, toner particles remain on the donor roll of the developer unit in the operative mode. This system of selective developer unit operation insures that each electrostatic latent image is individually developed with toner particles of the appropriate color without co-mingling of the toner particles. The developer system of the present invention will be discussed in greater detail hereinbelow.

After development, the toner image is moved to the transfer station where the toner image is transferred to a sheet of copy support material, such as plain paper amongst others. At the transfer station, the sheet transport apparatus, indicated generally by the reference numeral 48, moves the sheet into contact with photoconductive belt 20. Sheet transport 48 has a pair of spaced belts 54 entrained about rolls 50 and 52. A gripper mechanism extends between belts 54 and moves in unison therewith.

The sheet is advanced from a stack of sheets 56 disposed on a tray. A friction retard feeder 58 advances the uppermost sheet from stack 56 onto a pre-transfer transport 60. Transport 60 advances the sheet to sheet transport 48. The sheet is advanced by transport 60 in synchronism with the movement of the gripper mechanism so that the leading edge of the sheet arrives at a preselected position to be received and releasably secured to the gripper for movement in a recirculating path therewith. Accordingly, as the belts move in the direction of arrow 62, the sheet moves into contact with the photoconductive belt 20, in synchronism with the toner image developed thereon.

At the transfer zone, a transfer corona generating device 66 sprays ions onto the backside of the sheet so as to charge the sheet to a polarity opposite to that of the charge on the toner image. In this way, the sheet is charged to the proper magnitude and polarity for attracting the toner image from the photoconductive belt 20.

After the toner image is transferred to the sheet, the sheet is separated from the photoconductive belt 20, and passes between upper neutralizing corona generator 64 and lower neutralizing corona generator 65. The upper neutralization corona generator 64 applies a charge to the toner image of opposite polarity to the polarity on the toner image while the lower neutralization corona generator 65 applies a charge to the sheet of the same polarity as the charge on the toner image. The charge delivered to the toner image by upper neutralization corona generator 64 serves to discharge the toner image that was just transferred to the sheet, thereby improving the transfer efficiency of the next toner image in those areas where the transfer must occur on top of the now discharged toner image. Lower neutralization corona generator 65 acts as a ground plane behind the sheet for supplying to the toner image an amount of charge equal but of opposite polarity to that charge supplied by upper neutralization corona generator 64.

The sheet remains secured to the gripper so as to move in a recirculating path for four cycles. In this way, four different color toner images are transferred to the sheet in superimposed registration with one another. Each of the electrostatic latent images recorded on the photoconductive surface is developed with the appropriately colored toner which are transferred, in superimposed registration with one another, to the sheet to form the multi-color copy of the colored original document.

Following each transfer operation, detack corona generator 36 is energized to apply a charge to the sheet of a polarity which is the same as that of the charge on the toner image for separating the sheet from the photoconductive belt 20. After the last separation, the gripper mechanism opens to release the sheet. Conveyor 68 then transports the sheet, in the direction of arrow 70, to the fusing station. The fusing station includes a heated fuser roll 74 and a pressure roll 72. The sheet passes through the nip defined by fuser roll 74 and pressure roll 72. The toner image contacts fuser roll 74, which may include a heating element so as to be permanently affixed to the sheet. Thereafter, the sheet is advanced by forwarding roll pairs 76 to catch tray 78 for subsequent removal therefrom by the machine operator.

The last processing station in the direction of movement of belt 20, as indicated by arrow 22, is the cleaning station. A rotatably mounted fibrous brush 80 is positioned in the cleaning station and maintained in contact with photoconductive belt 20 to remove residual toner particles which invariably remain on the belt 20 after the transfer/detack operation. Thereafter, lamp 82 illuminates photoconductive belt 20 to remove any residual charge remaining thereon in preparation for the start of a successive imaging copy cycle.

It is believed that the foregoing description is sufficient for purposes of the present application to illustrate the general operation of an electrophotographic printing machine incorporating the development apparatus of the present invention therein.

Referring now to FIGS. 1 and 2, alternative embodiments of developer unit 40 are shown in greater detail. For the purpose of the present invention, only developer unit 40 will be described inasmuch as the other developer units are identical thereto, the only distinction being the color of the toner particles therein. Further, for the purposes of the following discussion, the term "toner" and "marking particles" will be understood to represesent interchangeable terms since the present invention relates to a single component development system using single component developer material comprising marking particles.

As shown in FIG. 1, developer unit 40 includes a housing 84 defining a chamber 86 for storing a supply of toner particles therein. Donor roll 88, intermediate donor roll 89 and toner advancing member 90 are mounted in the chamber 86 of housing 84 for transporting non-magnetic single component developer or toner to a position opposite photoreceptor 20. The donor roll 88 can be rotated in either the clockwise or counterclockwise direction so as to flow either in cooperation with, or in opposition to, the relative direction of motion of belt 20. In FIG. 1, donor roll 88 is shown rotating in the direction of arrow 92. Similarly, the intermediate donor roll 89, and the toner advancing member 90 can be rotated in either the clockwise or counterclockwise directions. In FIG. 1, the toner advancing member 90 is shown rotating in the direction of arrow 94.

Toner advancing member 90 is an elongated member located in chamber 86 and is preferably fabricated from an electrically conductive material, such as aluminum, coated with an insulating material, such as a plastic material. A motor (not shown) rotates the toner advancing member 90 at an angular velocity ranging from about 200 to about 600 revolutions per minute with the preferred set point being about 400 revolutions per minute. The toner advancing member 90 rotates in the direction of arrow 94, toner particles are fluidized and transported through the chamber 86.

As successive electrostatic latent images are developed, the toner particles within the developer material are depleted. A toner dispenser (not shown) is provided for storing a supply of toner particles. The toner dispenser is in communication with chamber 86 of housing 84. As the concentration of toner particles in the developer material is decreased, fresh toner particles are furnished to the developer material in the chamber 86 from the toner dispenser. The fresh toner particles are mixed with the remaining toner in the chamber 86 via toner advancing member 90 so that the resultant toner concentration in the chamber 86 is substantially uniform and optimized. In this way, a substantially constant amount of toner particles are in the chamber 86 of the developer housing 84 with the toner particles having a substantially constant charge. The toner particles are made from a resinous material, such as a vinyl polymer, mixed with a coloring material, such as chromogen black. However, one skilled in the art will recognize that other suitable toner material may be used.

As shown in FIG. 1, toner advancing member 90 includes a hollow rod or tube having four equally spaced rows of apertures or holes therein. Each row of holes is spaced about the periphery of the hollow rod by about 90°. Each hole in each row is spaced from the next adjacent hole. The holes are equally spaced from one another. In this way, as the tube rotates, the toner particles travel through the center of the tube and out through the various holes. The fluidized toner particles are advanced from one end of the chamber 86 of the developer housing 40 to the other end thereof by back pressure exerted by fresh or new toner particles being discharged into the chamber 86.

Elongated member 90 is spaced from intermediate donor roll 89, defining a gap therebetween across which toner is transferred. The gap between member 90 and intermediate donor roll 89 is preferably about 1.0 mm. Intermediate donor roll 89 is preferably made from a non-magnetic material, as for example, anodized aluminum having a polytetrafluoroethylene based resin such as TEFLON-S (trademark of E. I. DuPont de Nemours), having a thickness of approximately 0.05 mm coated thereon. As illustrated in FIG. 1, a DC voltage source 102 is coupled to toner advancing means 90, as well as to intermediate donor roll 89 for providing an electrical bias of approximately −750 volts thereto. DC voltage source 106 also provides an electrical bias of about +300 volts to intermediate donor roll 89. AC voltage source 110 further applies an approximate 100 volt AC bias potential to intermediate donor roll 89. These electrical biases establish an electrostatic field across between the toner advancing means 90 and the intermediate donor roll 89 so that toner particles are attracted from the toner advancing means 90 to the intermediate donor roll 89. The configuration provided by the present invention allows for toner transfer from a toner supply sump at a location which is relatively remote from the photoreceptor. This configuration puts distance between the transfer process to the intermediate transfer roll 89 and the photoreceptor 20, thereby inhibiting toner escape from the chamber 84. It has been found that this configuration significantly decreases toner escape, increases mechanical component life, and decreases background.

A metering blade 96 is resiliently urged into engagement with intermediate donor roll 89 as the intermediate donor roll 89 rotates in the direction of arrow 93. Metering blade 96 makes contact with intermediate donor roll 89 for the purpose of metering a uniform layer of toner on the surface of the intermediate donor roll 89 by regulating the thickness of the toner or marking particles thereon. Metering blade 96 is supported by leaf spring 98, having a free end for supporting and urging the metering blade against the intermediate donor roll 89. Metering blade 96 is maintained in contact with intermediate donor roll 89 at a nominal nip force ranging from about 25 grams per centimeter to about 100 grams per centimeter to provide a layer of marking particles thereon of approximately 0.9 milligrams/cm2. Leaf spring 98 is preferably made from sheet steel. One skilled in the art will appreciate that various suitable mounting means may be used to support metering blade 96 and to resiliently urge the metering blade 96 into contact with the intermediate donor roll 89.

Donor roll 88 is also a non-magnetic rigid roll, having the same or similar makeup as the intermediate donor roll 89. Non-magnetic intermediate donor roll 89 meters a constant quantity of toner, having a substantially constant charge, onto donor roll 88. This insures that the donor roll 88 provides a constant amount of toner, having a substantially constant charge, to the development gap opposite photoreceptor 20. DC bias supply 106 applies approximately 300 volts to donor roll 88 while AC source 110 provides approximately 100 volt AC bias potential to donor roll 88 to establish an electrostatic field between the intermediate donor roll 89 and donor roll 90. The bias voltages at each roll 88, 89 establish an electrostatic field therebetween which causes toner particles to be attracted from the intermediate donor roll 89 to the donor roll 88.

A cleaning blade 82 is provided for stripping all of the toner from intermediate donor roll 89 after transfer to the donor roll 88 so that advancing member 90 meters fresh toner to a clean intermediate donor roll 89. Further, a cleaning blade 95 is provided for stripping any excess of residual marking particles from the donor roll 88 after tranfer of the markings particles to the photoconductor. Various other mechanical devices may be implemented to provide cleaning of the rolls 88, 89. Alternatively, it will be appreciated that in lieu of using a cleaning balde, the combination of intermediate donor roll spacing, i.e. spacing between the donor roll 89 and the advancing member 90 or the spacing between roll 88 and 89, in conjunction with the conductive properties of the developer material, may achieve the deposition of a constant quantity of toner having a substantially constant charge on the intermediate donor roll 89.

In the embodiment shown in FIG. 1, final development of the electrostatic latent image on the photoreceptor 20 is accomplished via jumping development. Typically, jumping development involves generating an AC potential across the development gap for detaching toner from the donor roll and projecting toner onto the photoreceptor. The exemplary system of the present invention provides a peak AC voltage of approximately 1,000 Volts at approximately 1KHz to 4KHz across a 200 μm gap between the photoreceptor belt 20 and donor roll 88. A threshold field of ~3V/μm is required to detach the toner particles from the donor roll 88 to form a toner cloud which develops the electrostatic latent image by projection (jumping) of toner across the gap so that toner can come into contact with the electrostatic latent image. A high peak electric field is necessary to detach the toner from the donor roll 88 and to project it across the gap. The maximum peak electric field is limited by air breakdown to approximately 6V/μm. The narrow latitude between peak electric field and air breakdown requires a tight tolerance on the gap setting between the donor roll 88 and the photoreceptor belt 88.

Referring now to FIG. 2, there is shown an alternative embodiment of the development system of the present invention. Similar to FIG. 1, the development system of this alternative embodiment includes a housing 40 defining a chamber 86 for storing a supply of developer material therein. Toner advancing member 90, intermediate donor roll 89, and donor roll 88 are mounted in chamber 86 of housing 40, and are similar to the components discussed with respect to FIG. 1. This configuration, utilizing an intermediate donor roll 89 to collect marking particles from the advancing means 90 such that the intermediate donor roll 89 may provide a controlled amount of marking particles to the donor roll 88 provides an essential feature of the present invention by locating the interface between the intermediate donor roll 89 and the advancing member 90 deep inside the housing 40. Thus the intermediate donor roll 89 and the advancing member 90 are located progressively further from the image support surface than the donor roll 88, thereby substantially minimizing escape of the marking particles from the chamber of the housing.

The development system of FIG. 2 includes a scavengeless development system as is well known in the art. The system comprises electrode wires 42, disposed in the space between the belt 20 and donor roll 88 for providing a scavengeless development system, the operation of which is well known in the art. A pair of electrode wires 42 are shown extending in a direction substantially parallel to the longitudinal axis of the donor roll 88. The electrode wires 42 are made from of one or more thin (i.e. 50 to 100 μm diameter) tungsten wires which are closely spaced adjacent to donor roll 88. The distance between the wires and the donor roll 88 is approximately 25 μm or the thickness of the toner layer on the donor roll 88. The wires 42 are self-spaced from the donor roll 88 by an appropriate distance so that the thickness of the toner layer on the donor roll 88 can pass thereunder. To this end, the extremities of the wires 42 can be supported by bearing blocks which support the donor roll 88 for rotation. Mounting the wires 42 in such a manner makes them insensitive to roll runout due to their self-spacing.

As illustrated in FIG. 2, a direct current electrical bias is applied to the electrode wires 42 by a DC voltage source 112. The applied DC bias establishes an electrostatic field between the wires 42 and the donor roll 88 which is effective in detaching toner from the surface of the donor roll 88, forming a toner cloud about the wires 42, the height of the cloud being such as not to be substantially in contact with the belt 20. A variable DC bias supply 114 applies a biasing potential to donor roll 88 which establishes an electrostatic field between photoconductive surface of belt 20 and donor roll 88 for attracting the detached toner particles from the cloud surrounding the wires 42 to the latent image recorded on the photoconductive surface. At a spacing ranging from about 10 μm to about 40 μm between the electrode wires 42 and the donor roll 88, an applied voltage of approximately 200 to 500 volts produces a relatively large electrostatic field without risk of air breakdown. The use of a dielectric coating on either the electrode wires 42 or the donor roll 88 helps to prevent electrical shorting of the applied AC voltage. Once formed, the proximity of the toner cloud to the image receiving surface of photoreceptor 20 can be controlled by varying the DC bias voltage applied between the donor roll/wire electrode assembly and ground via DC source 112 and variable DC source 114.

In a scavengeless system, fringe electric fields supplied by biased electrodes 42 in close proximity with a toned donor roll 88 enable noninteractive development since the toner in the cloud formed near the electrodes is not projected against the image with high kinetic energy. The electric field is able to detach the toner from the donor roll to form a cloud near the wires. Since the toner cloud is spaced from the image receiver, toner does not impinge on the receiver which might scavenge previously deposited color toner. However, if the toner cloud is spaced too far away, the development of lines will be narrowed since the fringe fields at the edges of the lines do not reach into the toner cloud. To obtain line development fidelity, it is important to bring the toner cloud as close as possible to the image receiver without a strong scavenging interaction (for situations where there is a previously toned image). To accomplish this, one could either reduce the gap or increase the cloud height. The gap reduction approach has limitations since present manufacturing and machine setup tolerances require gaps $>200\ \mu m$. In connection with increasing the cloud height, it is noted that if the height of the toner cloud is proportional to the amplitude of toner particle motion due to an applied electric field, one expects the height to be proportional to the toner charge-to-mass ratio and the peak electric field. Since the ranges of the toner charge and peak electric field are limited, an increase in the bias voltage applied to electrodes 42 provides an effective way of increasing the cloud height.

In recapitulation, it is evident from the preceding description that a development system has been provided including a non-magnetic toner advancing member, and an intermediate donor roll in combination with a non-magnetic donor roll enclosed within a developer housing. The intermediate donor roll receives non-magnetic single-component toner particles from the toner advancing member. This configuration utilizes an intermediate donor roll to collect marking particles from the advancing means such that the intermediate donor roll may provide a controlled amount of marking particles to the donor roll positions the interface between the intermediate donor roll and the advancing member deep inside the housing. Thus, the intermediate donor roll and the advancing means are located progressively further from the image support surface than the donor roll, thereby substantially minimizing escape of the marking particles from the chamber of the housing. The toner advancing member and the intermediate donor roll are electrically biased relative to one another so that a quantity of toner particles having a substantially constant triboelectric charge is deposited onto the intermediate donor roll. The intermediate donor roll and the donor roll are also biased relative to one another so that a metered quantity of toner is deposited onto the donor roll. Toner is then transferred to the photoreceptive member to develop an electrostatic latent image thereon via known jumping or scavengeless development processes.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing an electrostatic latent image recorded on an image support surface with marking particles, comprising:

a housing, defining a chamber, for storing at least a supply of the marking particles therein;

means, disposed within the chamber of said housing, for advancing the marking particles therein;

a non-magnetic intermediate donor member, disposed within the chamber of said housing and proximate to said advancing means, said advancing means being adapted to transport the marking particles from the chamber of said housing to said intermediate donor member; and a non-magnetic donor member, adapted to transport the marking particles from said intermediate donor member to a development zone adjacent the image support surface so as to develop the latent image thereon with marking particles, said advancing means and said intermediate member being located progressively more distant from the image support surface than said donor member so as to substantially minimize escape of marking particles from the chamber of said housing.

2. An apparatus according to claim 1, further including means for applying a bias voltage to said intermediate donor member to attract marking particles thereto from said advancing means.

3. An apparatus according to claim 1, further including means for applying a bias voltage to said donor member to attract marking particles thereto from said intermediate donor member.

4. An apparatus according to claim 1, further including means, disposed adjacent said intermediate donor member, for metering the marking particles collected thereon.

5. An apparatus according to claim 1, wherein said advancing means includes a rotatably mounted elongated member.

6. An apparatus according to claim 5, wherein said elongated member includes a hollow tube having a plurality of apertures interspaced along a plurality of rows thereon for fluidizing the marking particles in said chamber of said housing.

7. An apparatus according to claim 1, further including means for applying an electrical bias to said advancing means.

8. An apparatus according to claim 1, further including:

electrode means disposed in said development zone between said image support surface and said donor member; and biasing means, coupled to said electrode means, for providing a bias potential thereto to detach marking particles from said donor member such that a cloud of marking particles is formed in said development zone, said of marking particles cloud being adapted to develop said electrostatic latent image.

9. An electrostatographic printing machine of the type in which an electrostatic latent image recorded on a photoconductive member is developed to form a visible image thereof, wherein the improvement includes:

a housing, defining a chamber, for storing at least a supply of the marking particles therein;

means, disposed within the chamber of said housing, for advancing the marking particles therein;

a non-magnetic intermediate donor member, disposed within the chamber of said housing and proximate to said advancing means, said advancing means being adapted to transport the marking particles from the chamber of said housing to said intermediate donor member; and a non-magnetic donor member, adapted to transport the marking particles from said intermediate donor member to a development zone adjacent the image support surface so as to develop the latent image thereon with marking particles, said advancing means and said intermediate member being located progressively more distant from the image support surface than said donor member so as to substantially minimize escape of marking particles from the chamber of said housing.

10. An apparatus according to claim 9, further including means for applying a bias voltage to said intermediate donor member to attract marking particles thereto from said advancing means.

11. An apparatus according to claim 9, further including means for applying a bias voltage to said donor member to attract marking particles thereto from said intermediate donor member.

12. An apparatus according to claim 9, further including means, disposed adjacent said intermediate donor member, for metering the marking particles collected thereon.

13. An apparatus according to claim 9, wherein said advancing means includes a rotatably mounted elongated member.

14. An apparatus according to claim 13, wherein said elongated member includes a hollow tube having a plurality of apertures interspaced along a plurality of rows thereon for fluidizing said marking particles in the chamber of said housing.

15. An apparatus according to claim 9, further including means for applying an electrical bias to said advancing means.

16. An apparatus according to claim 9, further including:

electrode means disposed in said development zone between said image support surface and said donor member; and biasing means, coupled to said electrode means, for providing a bias potential thereto to detach marking particles from said donor member such that a cloud of marking particles is formed in said development zone, said of marking particles cloud being adapted to develop said electrostatic latent image.

* * * * *